United States Patent [19]

Holland

[11] Patent Number: 4,501,120

[45] Date of Patent: Feb. 26, 1985

[54] REFRIGERATION SYSTEM WITH CLEARANCE SEALS

[75] Inventor: Noel J. Holland, Burlington, Mass.

[73] Assignee: Helix Technology Corporation, Waltham, Mass.

[21] Appl. No.: 416,350

[22] Filed: Sep. 9, 1982

Related U.S. Application Data

[63] Continuation-in-part of Ser. No. 241,418, Mar. 6, 1981, abandoned, which is a continuation-in-part of Ser. No. 135,141, Mar. 28, 1980, abandoned.

[51] Int. Cl.[3] ..... F25B 9/00

[52] U.S. Cl. ..... 62/6; 60/520; 277/216; 277/224

[58] Field of Search ..... 62/6; 60/520; 277/216, 277/224, DIG. 6

[56] References Cited

U.S. PATENT DOCUMENTS

| | | | |
|---|---|---|---|
| 3,020,056 | 2/1962 | Agens | 277/DIG. 6 |
| 3,364,675 | 1/1968 | Dorer | 62/6 |
| 3,415,054 | 12/1968 | Schulze | 62/6 |
| 3,788,088 | 1/1974 | Dehne | 62/6 |
| 3,928,974 | 12/1975 | Benson | 60/650 |
| 3,991,586 | 12/1976 | Acord et al. | 62/6 |
| 4,044,558 | 8/1977 | Benson | 60/520 |
| 4,060,250 | 11/1977 | Davis et al. | 277/DIG. 6 |
| 4,143,520 | 3/1979 | Zimmerman | 62/6 |
| 4,180,984 | 1/1980 | Chellis | 62/6 |
| 4,189,984 | 12/1980 | Tankred et al. | 92/82 |
| 4,244,192 | 1/1981 | Chellis | 62/6 |

OTHER PUBLICATIONS

Collins, S. C., "A Helium Cryostat", *Rev. of Sc Instruments*, vol. 18, No. 3, Mar. 1947, pp. 157–167.

Ferreira, L. E., and D. D. Briggs, "Aluminum Oxide and Berryllium Oxide Ceramics–Seal Materials of the Future", Coors Porcelain Co., No. 650303, pp. 153–155.

Kapitza, P., "The Liquefaction of Helium By An Adiabatic Method", Proc. Royal Soc. A147, 189 (1934).

Smirnov, E. N. and V. I. Epifanova, "Calculation of the Coefficient of Delivery for a High-Pressure Cryogen--Liquid Pump With Sealing Clearance", Chem. Petrol. Eng. N, Sep.-Oct. 1969, pp. 680–683.

"Engineering Ceramics", Engineering Materials and Design, Aug., 1977, pp. 19–20.

Taylor, C. O., R. M. Dix, W. C. Keith, L. M. Anderson and S. F. Tobias, "The Design and Development of A Miniature Split Stirling Refrigerator", Final Engineering Report by Texas Instruments Inc., Apr., 1976.

"Manufacturing Methods and Technology for the Establishment of Production Techniques for A Split-Cycle Stirling Cryogenic Cooler" First Quarterly Progress Report by Martin Marietta for Period of Oct. 1 through Dec., 31, 1977, Issued by United Stated Army Electronics Research & Development Command, Ft. Manmouth, New Jersey.

*Primary Examiner*—Ronald C. Capossela

*Attorney, Agent, or Firm*—Hamilton, Brook, Smith & Reynolds

[57] ABSTRACT

In a refrigeration system such as a split Stirling system, fluid seals associated with the reciprocating displacer are virtually dragless clearance seals. Movement of the displacer relative to the pressure variations in the working volume of gas is retarded by a discrete braking element. Because it is not necessary that the brake providing any sealing action, the brake can be designed for greater durability and less dependence on ambient and operating temperatures. Similarly, the clearance seal can be formed of elements having low thermal expansion such that the seal is not temperature dependent. In the primary embodiments the braking element is a split friction brake.

16 Claims, 8 Drawing Figures

REFRIGERATION SYSTEM WITH CLEARANCE SEALS

RELATED APPLICATIONS

This is a continuation-in-part of U.S. application Ser. No. 241,418, filed Mar. 6, 1981, which is a continuation-in-part of Ser. No. 135,141, filed Mar. 28, 1980, both abandoned.

DESCRIPTION

1. Field of the Invention

This invention relates to a refrigeration system and in particular to one in which a reciprocating displacer is driven by a pressure differential across that displacer such as a split Stirling cryogenic refrigerator.

2. Background Art

A conventional split Stirling refrigeration system is shown in FIGS. 1–4. This system includes a reciprocating compressor 14 and a cold finger 16. The piston 17 of the compressor provides a sinusoidal pressure variation in a pressurized refrigeration gas such as helium. The pressure variation in a head space 18 is transmitted through a supply line 20 to the cold finger 16.

The usual split Stirling system includes an electric motor driven compressor. A modification of that system is the split Vuilleumier. In that system a thermal compressor is used. This invention is applicable to both of those refrigerators as well as others.

Within the housing of the cold finger 16 a cylindrical displacer 26 is free to move in a reciprocating motion to change the volumes of a warm space 22 and a cold space 24 within the cold finger. The displacer 26 contains a regenerative heat exchanger 28 comprised of several hundred fine-mesh metal screen discs stacked to form a cylindrical matrix. Other regenerators, such as those with stacked balls, are also known. Helium is free to flow through the regenerator between the warm space 22 and the cold space 24. As will be discussed below, a piston element 30 extends upwardly from the main body of the displacer 26 into a gas spring volume 32 at the warm end of the cold finger.

The refrigeration system of FIGS. 1–4 can be seen as including two isolated volumes of pressurized gas. A working volume of gas comprises the gas in the space 18 at the end of the compressor, the gas in the supply line 20, and the gas in the spaces 22 and 24 and in the regenerator 28 of the cold finger 16. The second volume of gas is the gas spring volume 32 which is sealed from the working volume by a piston seal 34 surrounding the drive piston 30.

Operation of the conventional split Stirling refrigeration system will now be described. At the point in the cycle shown in FIG. 1, the displacer 26 is at the cold end of the cold finger 16 and the compressor is compressing the gas in the working volume. This compressing movement of the compressor piston 17 causes the pressure in the working volume to rise from a minimum pressure to a maximum pressure and this warms the working volume of gas. The pressure in the gas spring volume 32 is stabilized at a level between the minimum and maximum pressure levels of the working volume. Thus, at some point the increasing pressure in the working volume creates a sufficient pressure difference across the drive piston 30 to overcome the friction of displacer seal 36 and drive seal 34. The piston and displacer then move rapidly upward to the position of FIG. 2. With this movement of the displacer, high-pressure working gas at about ambient temperature is forced through the regenerator 28 into the cold space 24. The regenerator absorbs heat from the flowing pressurized gas and thereby reduces the temperature of the gas.

With the sinusoidal drive from a crank shaft mechanism, the compressor piston 17 now begins to expand the working volume as shown in FIG. 3. With expansion, the high pressure helium in the cold space 24 is cooled even further. It is this cooling in the cold space 24 which provides the refrigeration for maintaining a temperature gradient of over 200° K. over the length of the regenerator.

At some point in the expanding movement of the piston 17, the pressure in the working volume drops sufficiently below that in the gas spring volume 32 for the gas pressure differential across the piston portion 30 to overcome seal friction. The displacer 26 is then driven downward to the position of FIG. 4, which is also the starting position of FIG. 1. The cooled gas in the cold space 24 is thus driven through the regenerator to extract heat from the regenerator.

It has been understood that the phase relationship between the working volume pressure and the displacer movement is dependent upon the braking force of the seals on the displacer. If those seals provided very low friction, it had been understood that the displacer would move from the lower position of FIG. 1 to the upper position of FIG. 2 as soon as the working volume pressure increased past the pressure in the spring volume 32. Because the spring volume is at a pressure about midway between the minimum and the maximum values of the working volume pressure, movement of the displacer would take place during the midstroke of the compressor piston 17. This would result in compression of a substantial amount of gas in the cold end 24 of the cold finger, and because the compression of gas warms that gas this would be an undesirable result.

To increase the efficiency of the system, upward movement of the displacer is retarded until the compressor piston 17 is near the end of a stroke as shown in FIGS. 1 and 2. In that way, substantially all of the gas is compressed and thus warmed in the warm end 22 of the cold finger, and that warmed gas is then merely displaced through the regenerator 28 as the displacer moves upward. Thus, the gas then contained in the large volume 24 at the cold end is as cold as possible before expansion for further cooling of that gas. Similarly, it is preferred that as much gas as possible be expanded in the cold end of the cold finger prior to being displaced by the displacer 26 to the warm end. Again, the movement of the displacer must be retarded relative to the pressure changes in the working volume.

In prior systems, the seals 34 and 36 are precisely designed and fabricated to provide a predetermined amount of loading to the displacer and thus retard the displacer movement by an optimum amount. A major problem of split Stirling systems is that with wear of the seals the braking action of those seals varies. As the braking action becomes less the displacer movement is advanced in phase and the efficiency of the refrigerator is decreased. Also, braking action can be dependent on the direction of the pressure differential across the seal.

A primary object of the present invention is to provide sealing between the working volume and spring volume as well as consistent loading of the displacer even over long periods of use of the refrigerator.

In addition to the problem of wear of the seals, the refrigerator is often subjected to different environments. For example, a refrigerator may be stored at extremely high temperature and be called on to provide efficient cryogenic refrigeration. On the other hand, the refrigerator may be subject to very cold environments. The sealing action and friction of the seals is generally very dependent on temperature.

A further object of this invention is to provide sealing and braking action with minimum temperature dependence.

A problem common to all helium refrigerators is that, with wear, particles from worn seals contaminate the helium refrigerant. Those contaminants result in a significant degradation of performance and shorten the operating life of the refrigerator.

A further object of this invention is to provide a refrigeration system having a longer life than prior systems due to lesser wear to dynamic seals in the system.

SUMMARY OF THE INVENTION

In a refrigerator such as a split Stirling refrigerator, the fluid seals between the working volume and spring volume and between the warm and cold ends of the displacer are virtually dragless clearance seals which do not significantly retard movement of the displacer. The loading action for retarding movement of the displacer with pressure changes is provided by separate means which applies a predetermined load to the displacer. In preferred embodiments of the invention, the displacer loading results from friction other than that produced by the seals. In a primary example, friction is applied by a discrete, Coulomb friction brake.

Because the sealing and braking functions are separated, the Coulomb friction brake can be designed for optimum loading of the displacer over an extended life of the refrigerator without concern for providing sealing action. In fact, by equalizing the pressure across the braking element, changes in loading due to pressure differentials across the braking element are avoided. Also, the braking element may be isolated from the working volume so that debris generated with wear of the braking element does not contaminate the working volume. The clearance seal does not generate any detrimental contamination of the refrigerant.

In the preferred embodiment of the invention, the clearance seal is formed of hard ceramic material of low thermal expansion. Preferably, the clearance seal is at least 5 millimeters in length and the gap between the seal elements is no greater than about 0.004 millimeters.

In two forms of the invention, the braking elements are Coulomb friction brakes which are noncontinuous about the periphery of the displacer. In one form the brake comprises spring biased brake shoes and in another form the brake is a split ring.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DESCRIPTION OF PREFERRED EMBODIMENTS OF THE INVENTION

Figure 1:
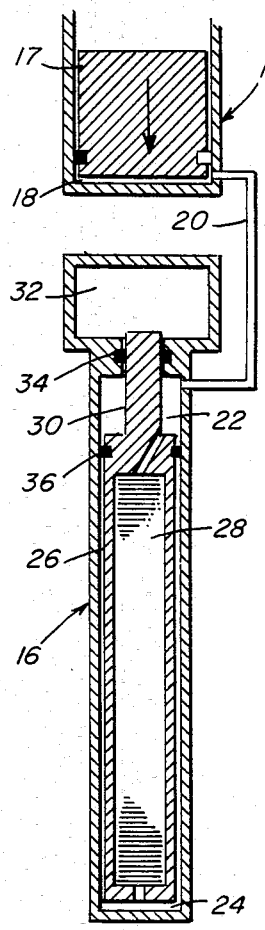
FIG. 1 (PRIOR ART)
FIGS. 1–4 illustrate the operation of a prior art split Stirling refrigerator.
Figure 2:
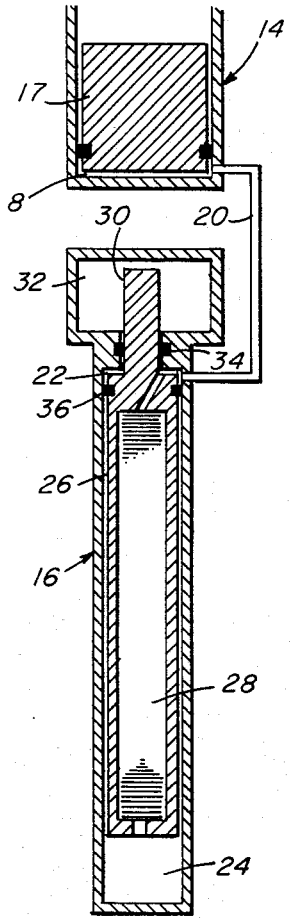
FIG. 2 (PRIOR ART)
Figure 3:
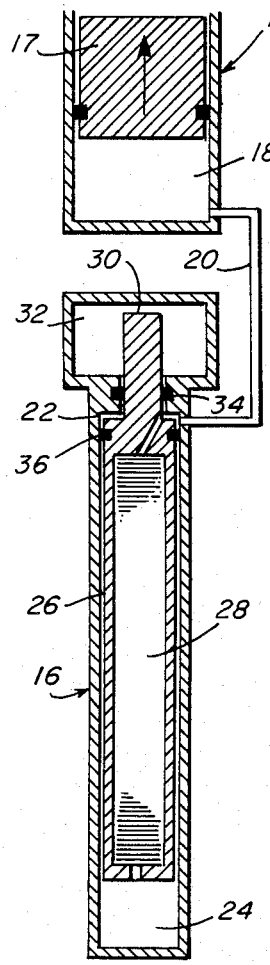
FIG. 3 (PRIOR ART)
Figure 4:
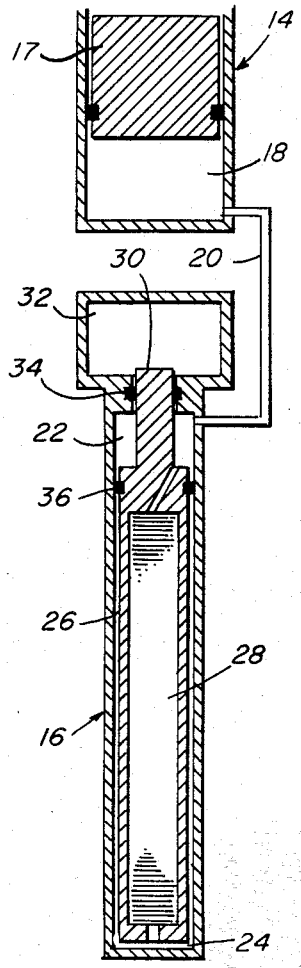
FIG. 4 (PRIOR ART)
Figure 5:
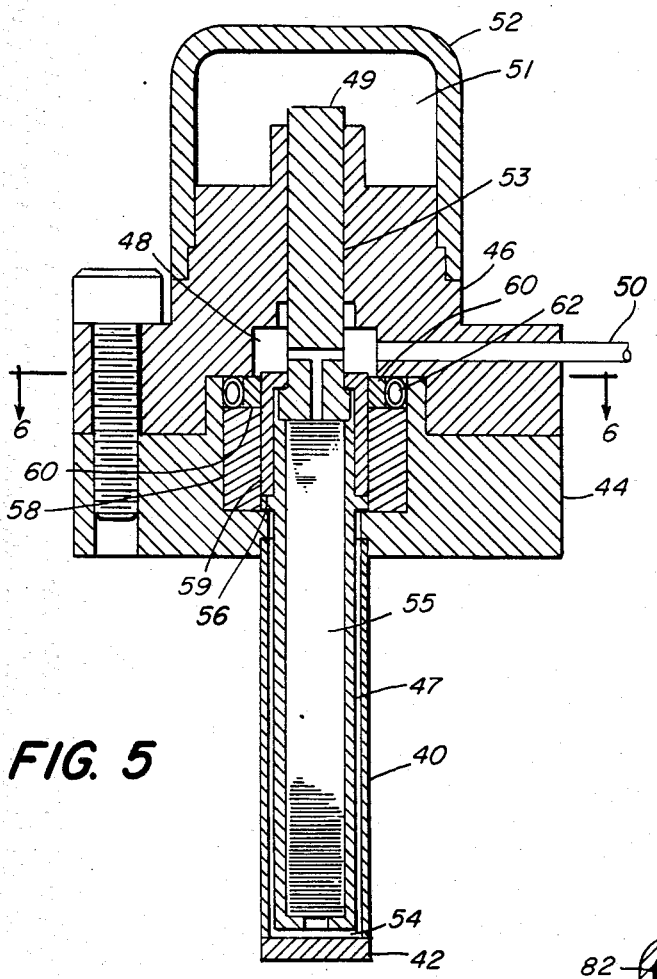
FIG. 5 is an elevational sectional view of a split Stirling refrigerator embodying the present invention.
Figure 6:
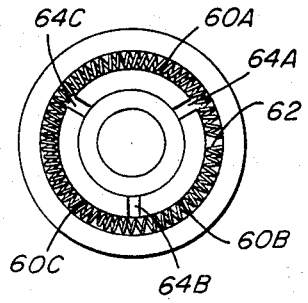
FIG. 6 is a cross-sectional view of the refrigerator of FIG. 5 taken along line 6—6.

As shown in FIGS. 5 and 6, a refrigerator includes a cylinder 40 having an end cap 42 and extending from a base plate 44. A working chamber head 46 is mounted to the plate 44 and has a warm portion 48 of the working chamber formed therein. A fluid line 50 extends from that working volume to a compressor as described with respect to the prior art.

A piston element 49 extends upwardly from the main body of a displacer 47. The piston 49 extends through the warm portion 48 of the working volume and through the head 46 to a spring volume 51. The spring volume is formed by the head 46 and a cap 52. The cylinder 40, plate 44, head 46 and cap 52 form a housing in which the displacer 47 reciprocates.

In accordance with this invention, the piston 49 is fabricated with a very close clearance fit to the head 46. The sealing between the warm volume and the spring volume 51 is thus provided by a clearance seal 53. With temperature stable material the seal is not greatly affected by variations in ambient temperature. With hard, smooth, abrasion resistant material, the clearance seal provides virtually dragless sealing action and long wear. The hardness of the clearance seal surfaces should be at least 60 on the Rockwell C scale and is preferably over 70 on the C scale. The abrasion resistance should be such that the wear rate of the two close fitting moving parts is less than about one microinch per thousand hour. With respect to smoothness, the finish should be better than 16 microinches.

The clearance seal elements, piston 49 and head 46 are made of ceramic, cermet, hardened steel, or other hard, abrasion resistant material. Cermets are materials comprising processed ceramic particles bonded with metal and used in high strength, abrasion resistant applications. Materials comprising ceramic are particularly suited for use in forming the clearance seal because ceramic does not suffer from the problem of galling, a welding action, that might result from the use of metal clearance seal surfaces. Ceramics include compounds of any of the metals or metal-like materials in groups II, III and IV of the periodic table combined with a non-metal, typically oxygen, nitrogen, sulfur, carbon, boron or silicon. Ceramics are characterized by being hard and abrasion resistant. Examples of such ceramics are aluminum oxide (alumina), beryllium oxide (beryllia), titanium dioxide, titanium diboride, boron carbide, silicon nitride and pyrolytic graphite. Other substances may be added to a ceramic to improve its characteristics. Alumina ($Al_2O_3$) is a preferred ceramic material; and titianium carbide mixed with alloy steels, such as that sold under the trademark FerroTic, is a preferred cermet. Although the piston and cylinder need not be solid ceramic, at least a bulk layer of ceramic should be provided on each of the piston and cylinder at the clearance seal to assure that these elements display the bulk characteristics of the ceramic.

In the usual application of this invention, the pressure differentials experienced between the working volume and the spring volume 51 are in the order of 75 pounds per square inch. To provide adequate sealing between the two volumes the clearance seal 53 should be about 5 millimeters long and a gap between the head 46 and piston 49 (half the diametrical clearance) should be no greater than about 0.004 millimeters.

A fluid seal is also provided between the warm portion of the working volume 48 and a cold portion 54 of the working volume to assure that all gas displaced by displacer 47 passes through the regenerator 55. This latter seal is formed of an inner ceramic ring 56 fixed to the displacer and an outer ceramic ring 58 fixed to the plate 44. As with the clearance seal 53, the elements of this clearance seal 59 are machined to extremely close tolerances with a gap of about 0.004 millimeters to provide virtually draglass sealing action. Material other than ceramic may also be used as discussed above.

In order to retard movement of the displacer relative to pressure variations in the working volume a discrete braking element 60 is provided. As shown in FIG. 6, the braking element is comprised of three brake shoes 60A, 60B and 60C spring biased toward the ring 56 by a coiled garter spring 62. The slits 64 between the braking shoes equalize the pressure across the braking element. Thus, the loading on the displacer is not dependent on pressure. Also, in the event of any wear of the brake shoes 60, the spaces 64 allow for inward movement of the brake shoes so that a near constant loading of the displacer can be maintained by the spring 62. Even that wear is minimized because, there being no requirement that the brake shoes provide for fluid sealing, those shoes can be of hard, durable material.

Figure 8:
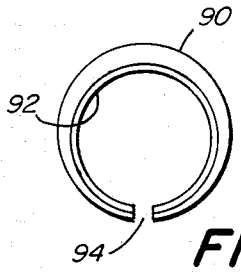
FIG. 8 is a cross-sectional view of the braking element of the embodiment of FIG. 7 taken along line 8—8.
Figure 7:
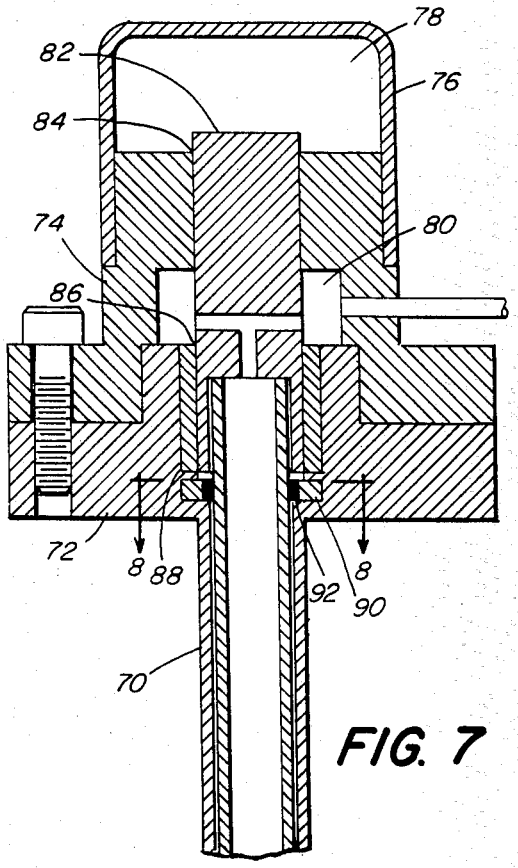
FIG. 7 is an elevational sectional view of an alternative embodiment of the invention.

In the embodiment of FIGS. 7 and 8, a cylinder 70 extends from a plate 72 as before. Also, a head 74 is mounted to the plate 72 and supports a cap 76. The spring volume 78 and warm portion of the working volume 80 are thus formed as before. In this embodiment, however, a piston element 82 which serves as one element of a clearance seal 84 also serves as an element of a clearance seal 86 between the warm and cold portions of the working volume. The head 74 and a ceramic ring 88 form the outer elements of the clearance seals. Loading of the displacer to retard its movement is provided by a split ring friction brake shown in FIG. 8. Split ring 90 has a hard, inner thermoplastic coating 92 which serves as the single brake shoe. The split 94 in the split ring allows for equalization of fluid pressure across the brake.

In each embodiment shown, the braking element is positioned in the working volume. To minimize contamination of the refrigerant in the working volume, the braking element can be positioned in the spring volume 51 or 78. As a result, the working volume is exposed only to the clearance seals which are virtually without wear, and the braking element is isolated from the working volume by a clearance seal.

In each of the above embodiments the seals around the displacer and piston are both clearance seals. This is ideal because the clearance seals are virtually dragless and are not subject to the wear of conventional seals. Also, the clearance seal about the piston assures equal leakage in each direction past the piston and thus assures a constant pressure in the spring volume.

While the invention has been particularly shown and described with reference to preferred embodiments thereof, it will be understood by those skilled in the art that various changes in form and details may be made therein without departing from the spirit and scope of the invention as described by the appended claims. For example, the invention has been illustrated by Coulomb friction brake embodiments. But the displacer retarding force might be applied by means of a magnetic coupling or the like. Friction brakes have the advantage of extracting work from the system.

An embodiment in which the retarding force is due primarily to fluid friction of the working fluid flowing through the regenerator has also been developed. In that embodiment, the displacer, including the drive piston, is dimensioned such that the pressure differentials resulting from the fluid friction and the drag of the fluid friction itself provide the proper retarding force. That embodiment is more specifically disclosed in an application Ser. No. 416,349 being filed concurrently herewith by the assignee of this invention in the name of Peter Bertsch.

I claim:

1. In a refrigerator having a displacer which reciprocates in a housing, there being a working volume of gas and a spring volume of gas in contact with end surfaces of the displacer and separated by a fluid seal surrounding the displacer, the displacer being driven entirely by pressure differentials between the working volume and the spring volume with the phase relationship between the pressure differential and the displacer movement being dependent on a retarding force on the displacer, the improvement of:

a clearance seal of cooperating clearance seal elements comprising ceramic material between the working volume and the spring volume to provide virtually dragless fluid sealing;

a clearance seal of cooperating clearance seal elements comprising ceramic material around the displacer, between portions of the working volume at opposite ends of the displacer, to provide virtually dragless fluid sealing; and means other than fluid seals for loading the displacer and thus retarding movement of the displacer.

2. An improvement in a refrigerator as claimed in claim 1 wherein the means for loading the displacer is a means for friction loading.

3. In a refrigerator having a displacer which reciprocates in a housing, there being a working volume of gas and a spring volume of gas in contact with opposing end surfaces of the displacer and separated by a fluid seal surrounding the displacer, the displacer being driven by pressure differentials between the working volume and the spring volume with the phase relationship between the pressure differential and the displacer movement being determined by a braking force on the displacer, characterized by:

all fluid seals between the displacer and housing being virtually dragless clearance seals, there being additional mechanical braking means other than the clearance seal for friction loading the displacer to retard movement of the displacer.

4. In a refrigerator having a displacer which reciprocates in a housing, there being a working volume of gas and a spring volume of gas in contact with opposing end surfaces of the displacer and separated by a fluid seal surrounding the displacer, the displacer being driven by pressure differentials between the working volume and the spring volume with the phase relationship between the pressure differential and the displacer movement being determined by a braking force on the displacer, the improvement of:

a clearance seal between the working volume and the spring volume to provide virtually dragless fluid sealing; and a discrete friction brake for applying a predetermined load to the displacer and thus retarding movement of the displacer, the brake allowing for equalization of fluid pressure thereacross.

5. The improvement in a refrigerator as claimed in claim 3 or 4 wherein cooperating clearance seal elements are of a hard material of low thermal expansion.

6. The improvement in a refrigerator as claimed in claim 5 wherein the clearance seal elements comprise ceramic material.

7. The improvement in a refrigerator as claimed in claim 5 wherein the clearance seal is at least 5 millimeters in length and the gap between the seal elements is no greater than about 0.004 millimeters.

8. An improvement in a refrigerator as claimed in claim 4 wherein the brake is a friction brake which is noncontinuous about the periphery of the displacer.

9. An improvement in a refrigerator as claimed in claim 8 wherein the friction brake comprises at least two brake shoes pressed against the displacer.

10. An improvement in a refrigerator as claimed in claim 9 wherein the brake shoes are pressed against the displacer by a spring element surrounding the displacer and shoes.

11. An improvement in a refrigerator as claimed in claim 8 wherein the friction brake is a split ring.

12. An improvement in a refrigerator as claimed in claim 4 further comprising a clearance seal around the displacer between portions of the working volume at opposite ends of the displacer.

13. An improvement in a refrigerator as claimed in claim 12 wherein the friction brake is positioned adjacent the clearance seal between the end portions of the working volume.

14. An improvement in a refrigerator as claimed in claim 3 or 4 wherein the portion of the displacer in contact with the spring volume is a center piston element extending axially from the main displacer body through and beyond a warm portion of the working volume.

15. In a refrigerator having a displacer which reciprocates in a housing, there being a working volume of gas and a spring volume of gas in contact with opposing end surfaces of the displacer and separated by a fluid seal surrounding the displacer, the displacer being driven by pressure differentials between the working volume and the spring volume with the phase relationship between the pressure differential and the displacer movement being determined by a braking force on the displacer, the improvement of:

a clearance seal of cooperating clearance seal elements comprising ceramic material between the working volume and the spring volume to provide virtually dragless fluid sealing;

a clearance seal of cooperating seal elements comprising ceramic material around the displacer, between portions of the working volume at opposite ends of the displacer, to provide virtually dragless fluid sealing; and a discrete friction brake for applying a predetermined load to the displacer and thus retarding movement of the displacer, the brake allowing for equalization of fluid pressure thereacross.

16. In a refrigerator having a displacer which reciprocates in a housing free of any electric motor, there being a working volume of gas and a spring volume of gas in contact with end surfaces of the displacer and separated by a fluid seal surrounding the displacer, the displacer being driven entirely by pressure differentials between the working volume and the spring volume with the phase relationship between the pressure differential and the displacer movement being dependent on a retarding force on the displacer, the improvement of:

a clearance seal of cooperating clearance seal elements comprising ceramic material between the working volume and the spring volume to provide virtually dragless fluid sealing;

a clearance seal of cooperating clearance seal elements comprising ceramic material around the displacer, between portions of the working volume at opposite ends of the displacer, to provide virtually dragless fluid sealing; and means other than fluid seals for developing a retarding force for loading the displacer and thus retarding movement of the displacer, substantially the entire retarding force resulting from friction other than friction of fluid seals.

* * * * *